US010547153B2

(12) United States Patent
Lin

(10) Patent No.: US 10,547,153 B2
(45) Date of Patent: Jan. 28, 2020

(54) CRIMPING HAND TOOL

(71) Applicant: JETOOL CORP., New Taipei (TW)

(72) Inventor: Kai-Yen Lin, New Taipei (TW)

(73) Assignee: JETOOL CORP., New Taipei (TW)

( * ) Notice: Subject to any disclaimer, the term of this patent is extended or adjusted under 35 U.S.C. 154(b) by 261 days.

(21) Appl. No.: 15/641,237

(22) Filed: Jul. 4, 2017

(65) Prior Publication Data

US 2018/0294613 A1 Oct. 11, 2018

(30) Foreign Application Priority Data

Apr. 7, 2017 (TW) ..... 106111726 A

(51) Int. Cl.
*H01R 43/042* (2006.01)
*B25B 27/14* (2006.01)

(52) U.S. Cl.
CPC ..... *H01R 43/0421* (2013.01); *B25B 27/146* (2013.01)

(58) Field of Classification Search
CPC ..... B25B 27/146; H01R 43/0421
See application file for complete search history.

(56) References Cited

U.S. PATENT DOCUMENTS 3,075,198 A * 1/1963 Over ..... H01R 43/045 29/751
3,328,872 A * 7/1967 Reem ..... H01R 43/0421 140/121
4,790,068 A * 12/1988 Sato ..... H01R 43/0421 29/751
6,109,088 A * 8/2000 Schrader ..... H01R 43/042 29/751
6,948,234 B1 * 9/2005 Steiner ..... H01R 43/0425 29/748
8,656,580 B2 * 2/2014 Steiner ..... B25B 27/10 29/751
2018/0294613 A1 * 10/2018 Lin ..... B25B 27/146

* cited by examiner

*Primary Examiner* — Minh N Trinh
(74) *Attorney, Agent, or Firm* — JCIPRNET

(57) ABSTRACT

A crimping hand tool used for crimping a plurality of wires of a cable into a jack is provided. The crimping hand tool includes a first body, a second body, a linking member, a crimping assembly, and a first base. Two opposite ends of the linking member are pivoted to the first and the second crimping bodies respectively. The crimping assembly slidably assembled to the first body is pivoted to the second body. The first base movably assembled to the first body is located on a moving path of the crimping assembly. The first base has a plurality of supporting areas that switchably face toward the crimping assembly. The wires are disposed on the jack temporarily, and at least one of the first and the second crimping bodies is forced to slide the crimping assembly toward the supporting area to crimp the wires into the jack.

19 Claims, 10 Drawing Sheets

CRIMPING HAND TOOL

CROSS-REFERENCE TO RELATED APPLICATION

This application claims the priority benefits of Taiwan application serial no. 106111726, filed on Apr. 7, 2017. The entirety of the above-mentioned patent application is hereby incorporated by reference herein and made a part of this specification.

BACKGROUND OF THE INVENTION

Field of the Invention

The invention relates to a crimping hand tool.

Description of Related Art

Nowadays, various cable wires and signal connectors have been widely used for signal transmission, such as network cables and RJ45 connectors that serve to transmit network signals and telephone cables and RJ11 connectors that serve to transmit telephone signals. For the purpose of connecting the cable to the required equipment, the terminal end of the cable is usually connected to a corresponding connector to form a cable connector. Hence, it is necessary to use a specialized cable crimping tool to connect and fix the cable and the connector together.

To take the network cable as an example, the cable is usually directly inserted into piercing terminals of the connector so that the piercing terminals cut through an insulation material outside the cable to be electrically connected to wires inside the cable. In other words, it only takes one simple, quick squeezing and pressing operation to achieve the electronic connection between the connector and the cable. However, since the network cable usually has many small wires located inside, the connector correspondingly has piercing terminals of the same amount that must be electrically connected to the wires. But it is quite a waste of time to insert the wires one by one.

SUMMARY OF THE INVENTION

The invention provides a crimping hand tool that effectively improves the convenience, efficiency and application range of the operation of crimping wires into a jack.

The crimping hand tool of the invention is adapted to crimp a plurality of wires of a cable into a jack. The crimping hand tool includes a first body, a second body, a linking member, a crimping assembly, and a first base. Two opposite ends of the linking member are pivoted to the first body and the second body respectively. The crimping assembly is slidably assembled to the first body and pivoted to the second body. The first base is movably assembled to the first body and located on a moving path of the crimping assembly. The firs base has a plurality of supporting areas, and each of the supporting areas switchably faces toward the crimping assembly by following the first base that moves with respect to the first body. The jack is adapted to be placed in one of the supporting areas to face toward the crimping assembly. The wires are adapted to be disposed on the jack temporarily. At least one of the first body and the second body is forced to slide the crimping assembly toward the supporting area through the second body and the linking member so as to crimp the plurality of wires into the jack.

In an embodiment of the invention, the crimping assembly is slidably assembled to the first body along a first axis, the first base is pivoted to the first body along a second axis, and the first axis is orthogonal to the second axis.

In an embodiment of the invention, a structure extension direction of the first body coincides with the first axis.

In an embodiment of the invention, the first body further has a connecting base portion located in the first accommodating groove of the first body, and the first base is pivoted to the connecting base portion.

In an embodiment of the invention, the crimping assembly includes a second base and a crimping head. The second base is slidably assembled to a guiding portion of the first body, and the second body is pivoted to the second base. The crimping head is detachably assembled to the second base.

In an embodiment of the invention, the crimping hand tool further includes an elastic member connected between the second base and the linking member.

In an embodiment of the invention, the first body further has a third base facing away from the second base and adapted to accommodate another crimping head.

In an embodiment of the invention, the crimping head includes a main body, a plurality of crimping protruding members, and at least one cutting tool. The crimping protruding members are disposed inside the main body in an array, and when the crimping assembly moves toward the supporting area, the crimping protruding members correspondingly crimp the wires into the jack. The cutting tool is assembled to the main body and located on at least one side of the plurality of crimping protruding members, wherein orthogonal projections of the plurality of crimping protruding members onto the at least one cutting tool are located within a range of the at least one cutting tool and are spaced apart.

In an embodiment of the invention, the at least one cutting tool includes a pair of cutting tools located on two opposite sides of the crimping protruding members.

In an embodiment of the invention, the first body has a first accommodating groove that forms at least a portion of the guiding portion, and the second base slidably contacts the first accommodating groove.

In an embodiment of the invention, the first accommodating groove further has at least one reaming groove located on at least one inner wall of the first accommodating groove. The second base has at least one sliding block slidably assembled to the at least one reaming groove. The at least one reaming groove forms another portion of the guiding portion.

In an embodiment of the invention, one end of the linking member has a ratchet structure, and the crimping hand tool further includes a stopping block pivoted to the second body to temporarily interfere with the ratchet structure.

In an embodiment of the invention, the stopping block has a force application portion that extends to and protrudes out of an exterior part of the linking member. The force application portion is adapted to be forced to drive the stopping block so as to make the stopping block either interfere with or move away from the ratchet structure.

In an embodiment of the invention, the crimping hand tool further includes a knob disposed on the second body to connect the force application portion.

In an embodiment of the invention, the first body includes a first portion and a second portion that are coupled and assembled together. The linking member is pivoted between the first portion and the second portion.

In an embodiment of the invention, the first body further includes a third portion that has a concave structure, and the first portion and the second portion are assembled in the concave structure and face each other. The concave structure, the first portion and the second portion form a first accommodating groove of the first body. The linking member is movably located in the first accommodating groove.

In an embodiment of the invention, the linking member includes a fourth portion and a fifth portion that are coupled. One end of the fourth portion and one end of the fifth portion are pivoted to the first body respectively.

In an embodiment of the invention, at least one of another end of the fourth portion and another end of the fifth portion has a ratchet structure.

In an embodiment of the invention, the second body includes a sixth portion and a seventh portion that are coupled and assembled together. The linking member is pivoted between the sixth portion and the seventh portion.

In an embodiment of the invention, the second body further includes an eighth portion that has another concave structure. The sixth portion and the seventh portion are assembled in the another concave structure and face each other. The another concave structure, the sixth portion and the seventh portion form a second accommodating groove of the second body. The linking member is movably located in the second accommodating groove.

Based on the above, by the linking member, the crimping hand tool is capable of driving the crimping assembly when at least one of the first body and the second body is forced, thereby sliding the crimping assembly toward one of the supporting areas of the first base to perform the crimping operation. Accordingly, the user first temporarily disposes the plurality of wires of the cable on the jack and then places the cable and the jack in the supporting area so as to crimp all the wires into the jack simultaneously by the foregoing crimping operation to complete the crimping process of the cable.

Furthermore, the first base has a plurality of supporting areas that correspond to different types of jacks and are switchable in accordance with the first base that is movably assembled to the first body. Consequently, the same crimping hand tool may be used to complete the required crimping operation on all these different types of jacks.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
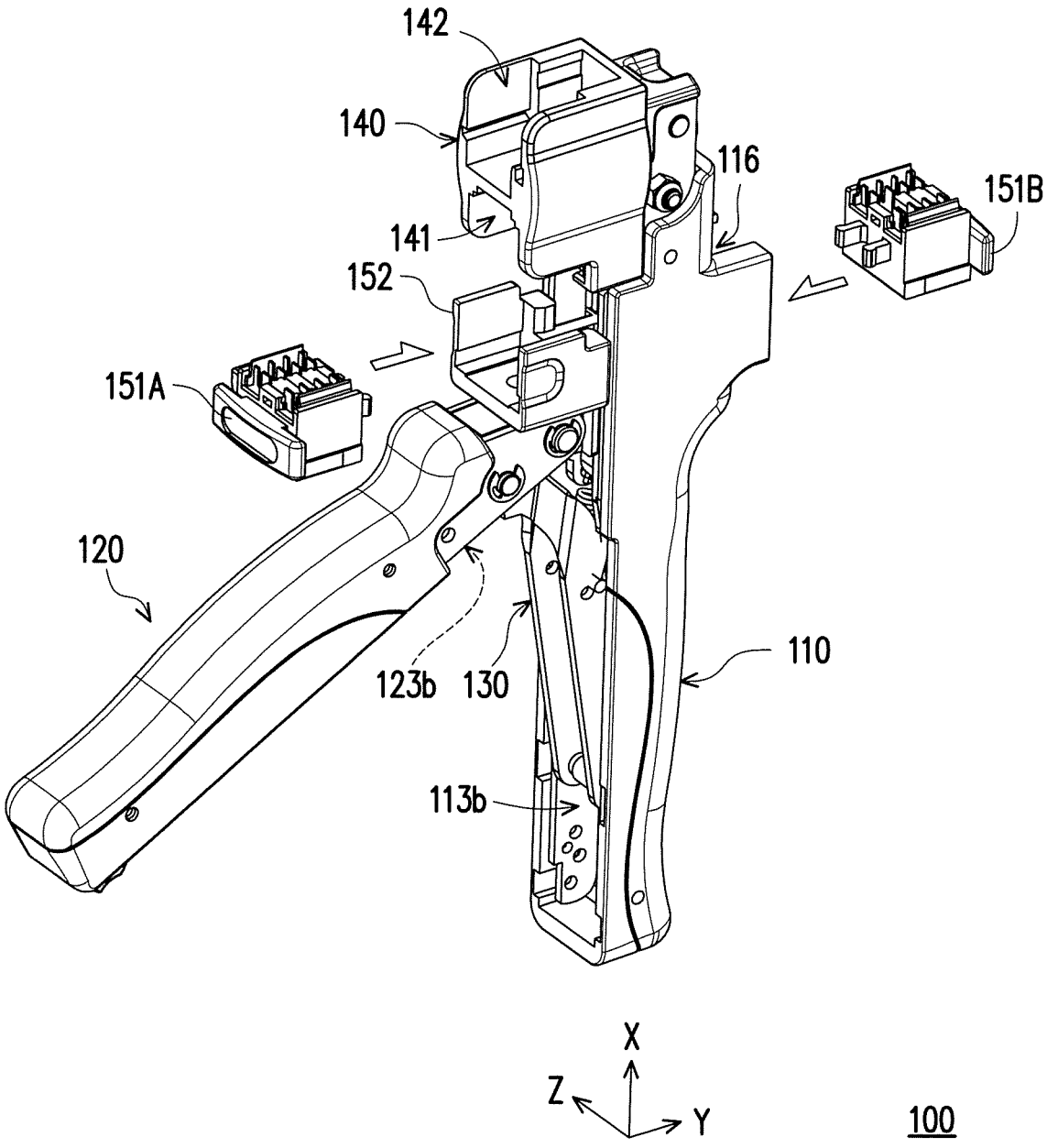
FIG. 1 is a schematic view of a crimping hand tool according to an embodiment of the invention.
Figure 2:
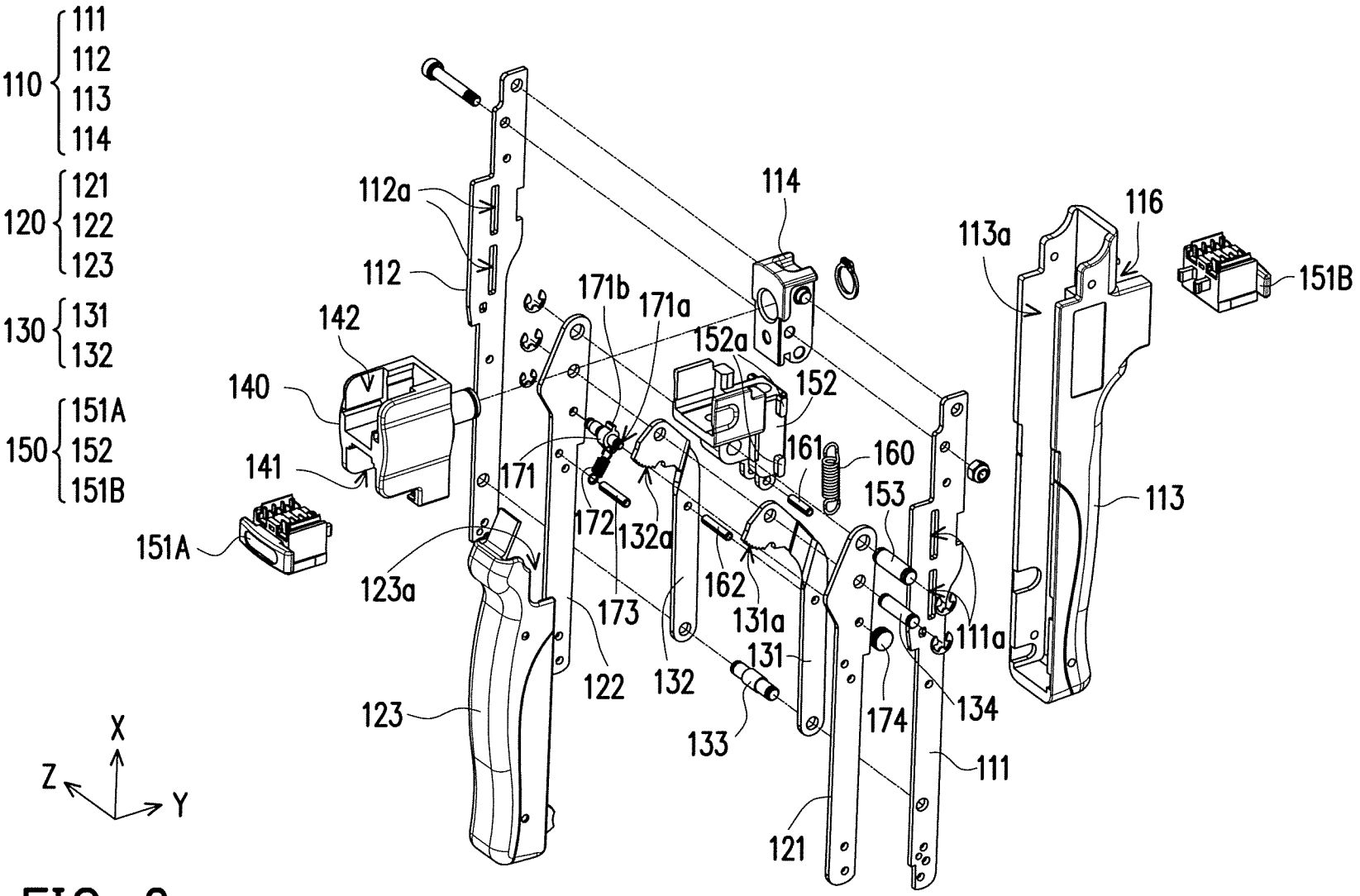
FIG. 2 is an exploded view of the crimping hand tool of FIG. 1.

FIG. 1 is a schematic view of a crimping hand tool according to an embodiment of the invention. FIG. 2 is an exploded view of the crimping hand tool of FIG. 1. A rectangular X-Y-Z coordinate system is simultaneously provided to facilitate component description. In this embodiment, a crimping hand tool 100 includes a first body 110, a second body 120, a linking member 130, a crimping assembly 150, and a first base 140. Two opposite ends of the linking member 130 are pivoted to the first body 110 and the second body 120 respectively. The crimping assembly 150 is slidably assembled to the first body 110 along a first axis (i.e., the X axis). The linking member 130 is connected to the crimping assembly 150. The first base 140 is movably assembled to the first body 110 and located on a moving path of the crimping assembly 150.

Here the first base 140 has supporting areas 141 and 142 that switchably face toward the crimping assembly 150 by following different operation modes of the first base 140 with respect to the first body 110. Furthermore, the first base 110 may have different types of the supporting areas 141 and 142 in response to the types of jacks. Although the two supporting areas 141 and 142 are taken as an example here, the number of the supporting area is not limited thereto. During the crimping process, a jack is adapted to be placed in the supporting area of the corresponding type so that the crimping assembly 150, driven by the linking member 130, crimps wires of a cable into the jack. Further explanation will be provided in the following sections.

Specifically, the first body 110 includes a first portion 111, a second portion 112, a third portion 113, and a connecting base portion 114. The first portion 111 and the second portion 112 are coupled to each other. The third portion 113 has a concave structure 113 *a* so that the first portion 111 and the second portion 112 are accommodated into the concave structure 113*a* to face each other. Besides, the concave structure 113*a*, the first portion 111 and the second portion 112 together form a first accommodating groove 113*b* of the first body 110, allowing the linking member 130 to be movably located in the first accommodating groove 113*b*. The connecting base portion 114 is located in the first accommodating groove 113*b*, and the first base 140 is pivoted to the connecting base portion 114 along a second axis (i.e., the Y axis). The crimping assembly 150 includes a second base 152 and a crimping head 151A. Here the second base 152 is slidably assembled to the first body 110 along the X axis, and the second body 120 is pivoted to the second base 152. The crimping head 151A is adapted to be detachably accommodated in the second base 152 along the Y axis so as to follow the second base 152 to move toward or away from the first base 140 along the X-axis. Here a structure extension direction of the first body 110 coincides with the X-axis.

In other words, the first body 110 and the second body 120 of the crimping hand tool 100 are respectively pivoted to the linking member 130 to achieve a pivoting effect, and the crimping assembly 150 is slidably assembled to the first body 110 while pivoted to the second body 120. Consequently, when at least one of the first body 110 and the second body 120 receives an external force so as to be pivoted with respect to each other, the pivoting movement of the second body 120 drives the crimping assembly 150 to slide on the first body 110, thereby achieving the required crimping operation.

It should be noted that in another embodiment (not shown), the first portion, the second portion and the third portion may be an integrally formed structure to facilitate simplification of the component assembly process.

Furthermore, with reference to FIG. 2 again, in this embodiment, the second base 152 has a sliding block 152*a*, and the first portion 111 and the second portion 112 of the first body 110 each have a guiding portion, such as a reaming groove 111*a* and a reaming groove 112*a* that extend along the X-axis. The sliding block 152*a* is coupled to the reaming grooves 111*a* and 112*a* that the second base 152 is located between the first portion 111 and the second portion 112, such that the second base 152 may slide along the X-axis with respect to the first body 110. But the embodiment does not intend to limit the type of the guiding portion. In addition to the reaming grooves 111*a* and 112*a*, structural features inside the first accommodating groove 113*b* of the first body 110, such as the structural plane contacting the second base 152 and an inner wall of the first accommodating groove 113*b*, may also achieve the effect of the second base 152 sliding along the X-axis, and thus may also be viewed as guiding portions provided by the first body 110 to the second base 152.

In this embodiment, the linking member 130 includes a fourth portion 131 and a fifth portion 132 that are coupled. The second body 120 includes a sixth portion 121, a seventh portion 122 and an eighth portion 123. Here the eighth portion 123 has a concave structure 123*a*, and the sixth portion 121 and the seventh portion 122 are coupled and assembled in the concave structure 123*a*. One end of the fourth portion 131 and one end of the fifth portion 132 are pivoted between the first portion 111 and the second portion 112 of the first body 110 by a pivoting member 133, while the other end of the fourth portion 131 and the other end of the fifth portion 132 are pivoted between the sixth portion 121 and the seventh portion 122 of the second body 120 by a pivoting member 134. Therefore, the second body 120 has structural features similar to those of the first body 110. The concave structure 123*a*, the sixth portion 121 and the seventh portion 122 form a second accommodating groove 123*b* of the second body 120, allowing a portion of the linking member 130 that is adjacent to the pivoting member 134 to be movably located in the second accommodating groove 123*b*. Similar to the first body 110 that has the first portion 111 and the second portion 112, the linking member 130 and the second body 120 likewise have similar coupled components. But the invention is not limited thereto. The integrally formed structure of the first body as described above is also applicable to the linking member and the second body and may serve as structural features thereof. Besides, the sixth portion 121 and the seventh portion 122 are further pivoted to the second base 152 by a pivoting member 153.

Figure 3:
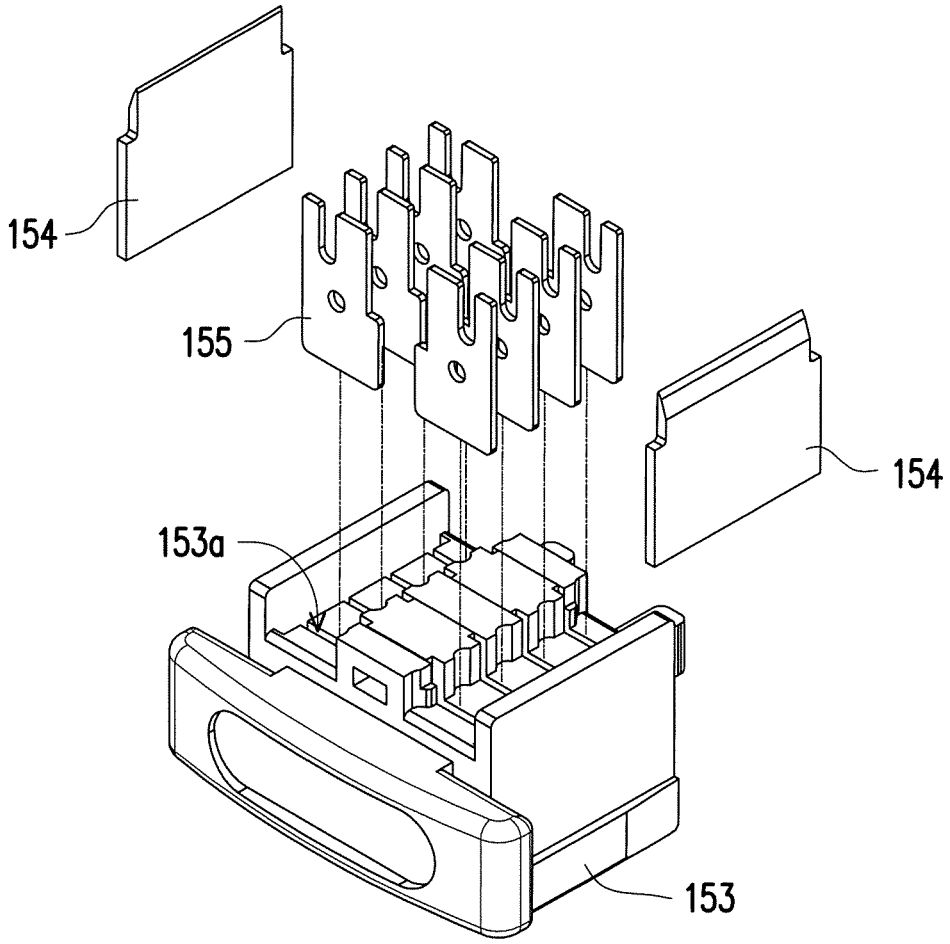
FIG. 3 illustrates an exploded view of the crimping head of the crimping assembly of FIG. 1 and FIG. 2.

FIG. 3 illustrates an exploded view of the crimping head of the crimping assembly of FIG. 1 and FIG. 2. With reference to FIG. 1 to FIG. 3 simultaneously, in this embodiment, the crimping head 151A includes a main body 153, a plurality of crimping protruding members 155 and at least one cutting tool 154. The main body 153 has a plurality of groove-shaped structures 153*a*, and the crimping protruding members 155 are disposed inside the main body 153 in an array and correspond to the groove-shaped structures 153*a* respectively. The cutting tool 154 is assembled to the main body 153 and located on at least one side of the crimping protruding members 155, whereas orthogonal projections of the crimping protruding members 155 on the cutting tool 154 are located within the range of the cutting tool 154 and are spaced apart. More specifically, the crimping protruding members 155 of this embodiment are arranged at equal intervals. In other embodiments (not shown), the crimping protruding members may be arranged differently in accordance with the grooves of the jack, such as arranged at unequal intervals or arranged obliquely. Here the crimping protruding members 155 correspond to crimping places between the jack and the wires. In this embodiment, a pair of the cutting tools 154 are respectively provided on two opposite sides of the main body 153 and the crimping protruding members 155 to correspond to the portions of the wires that protrude out of the jack. Further explanation will be provided in the following sections.

Figure 4:
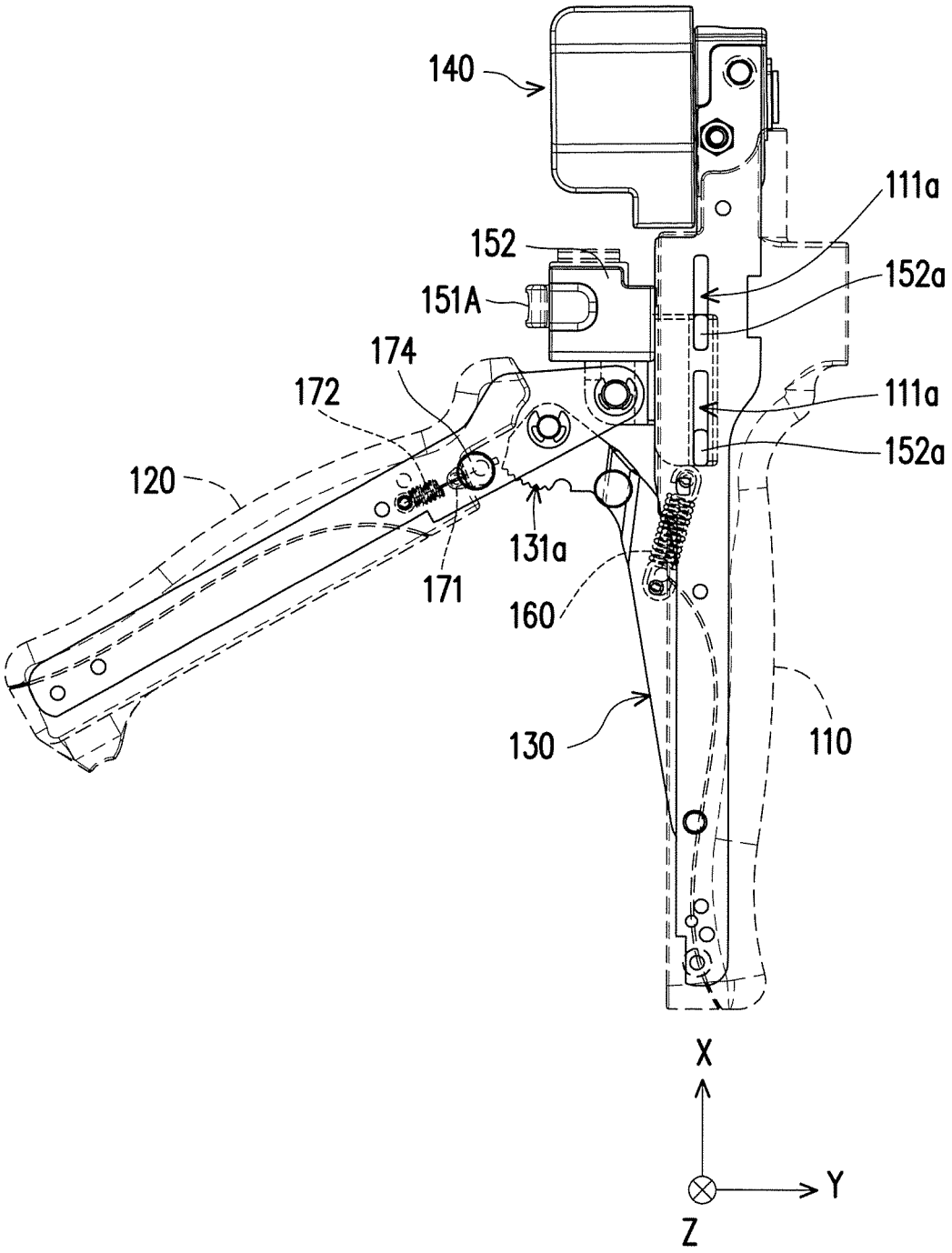
FIG. 4 and FIG. 5 are respectively schematic views illustrating the operation of the crimping hand tool.
Figure 5:
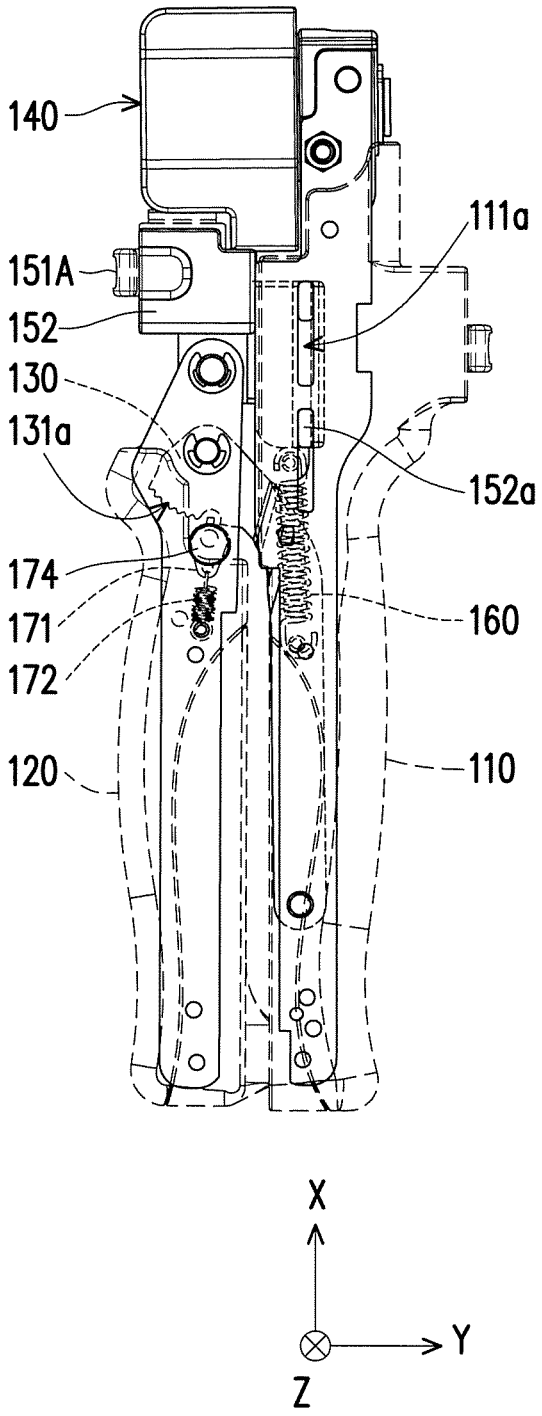
Figure 6A:
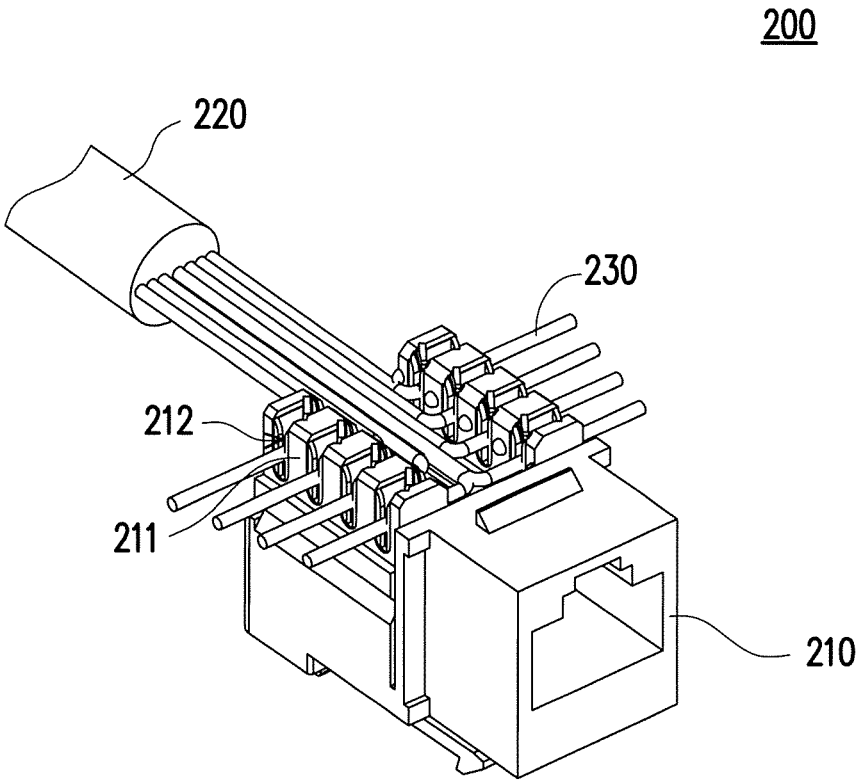
FIG. 6A to FIG. 6C are schematic views showing how to crimp wires into a jack.
Figure 6B:
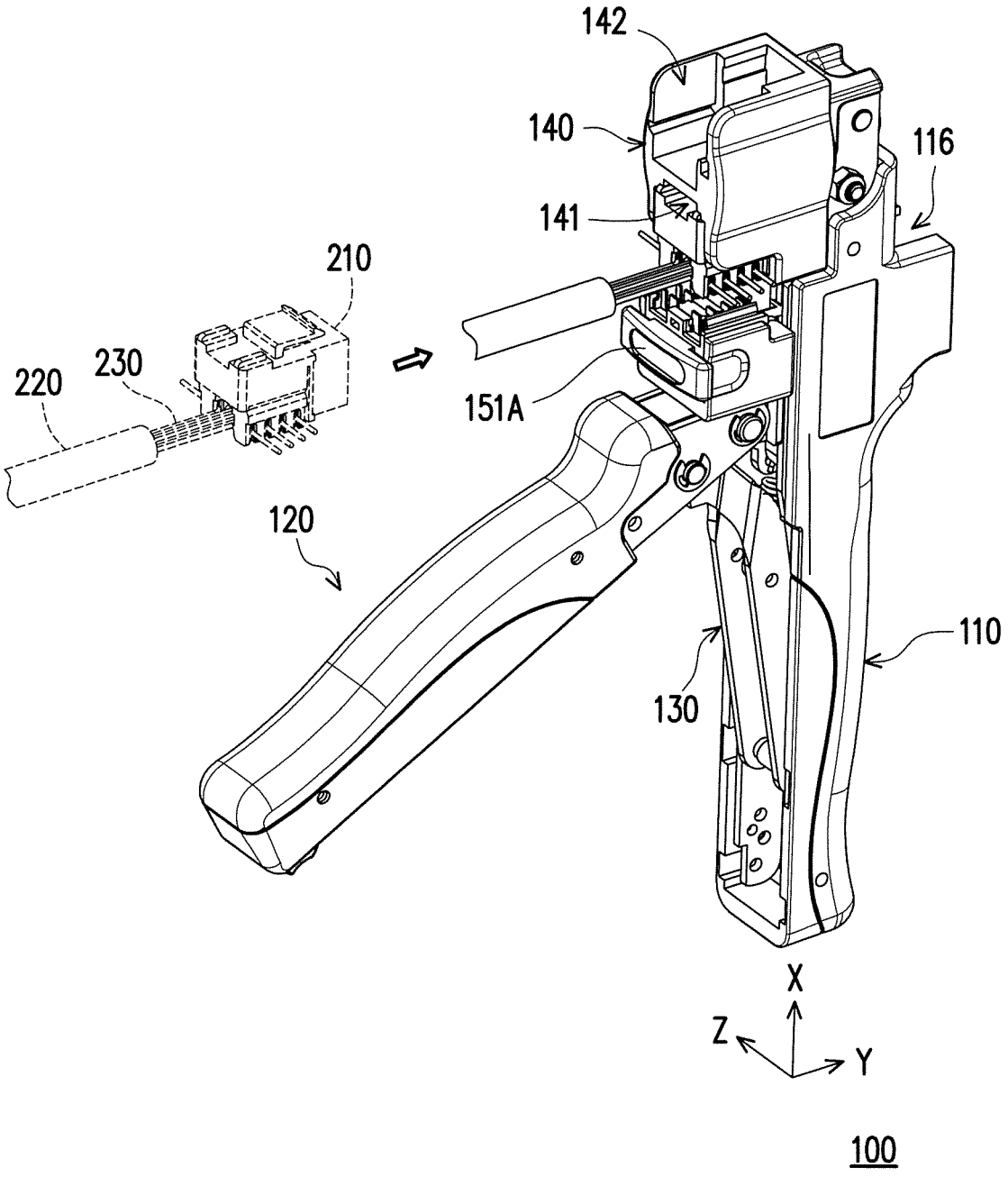
Figure 6C:
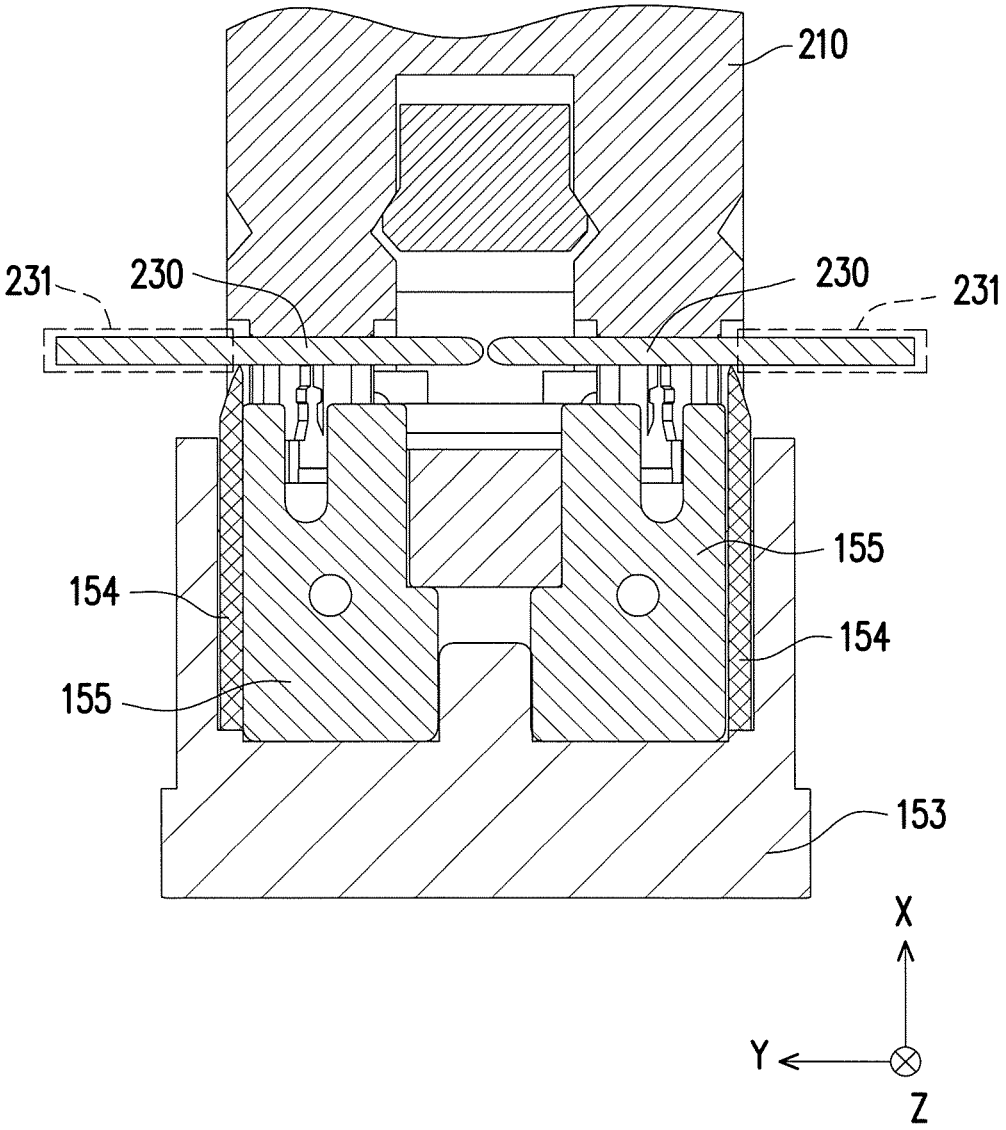

FIG. 4 and FIG. 5 are respectively schematic views illustrating the operation of the crimping hand tool, and some of the components here are shown in dotted lines to attain a perspective effect and to facilitate identification. FIG. 6A to FIG. 6C are schematic views showing how to crimp wires into a jack. With reference to FIG. 6A first, in this embodiment, a user first temporarily disposes a plurality of wires 230 of a cable 220 in a plurality of grooves 212 of the jack 210 respectively. The grooves 212 are formed by adjacent projections 211 and, as shown in FIG. 6A, the wires 230 have parts that protrude out of the jack 210. Then, as shown in FIG. 6B, the user places the cable 220 and the jack 210 that are in a temporary connecting state into the corresponding supporting area 141 of the first base 140 of the crimping hand tool 100. Next, as shown in FIG. 4 and FIG. 5, when the user applies a force to the first body 110 and/or the second body 120 to make them pivoted with respect to each other, the second base 152 and the crimping head 151A on the second base 152 are then driven to move toward the supporting area 141 of the first base 140. As shown in FIG. 6C, the crimping protruding members 155 of the crimping head 151A, in a single crimping operation, crimp the plurality of wires 230 simultaneously into the jack 210 so that the wires 230 are locked to the grooves 212. At the same time, following the movement of the crimping protruding members 155, the cutting tool 154 cuts off protruding parts 231 of the wires 230 that protrude with respect to the jack 210 to complete the crimping process of a cable connector assembly 200.

Figure 7:
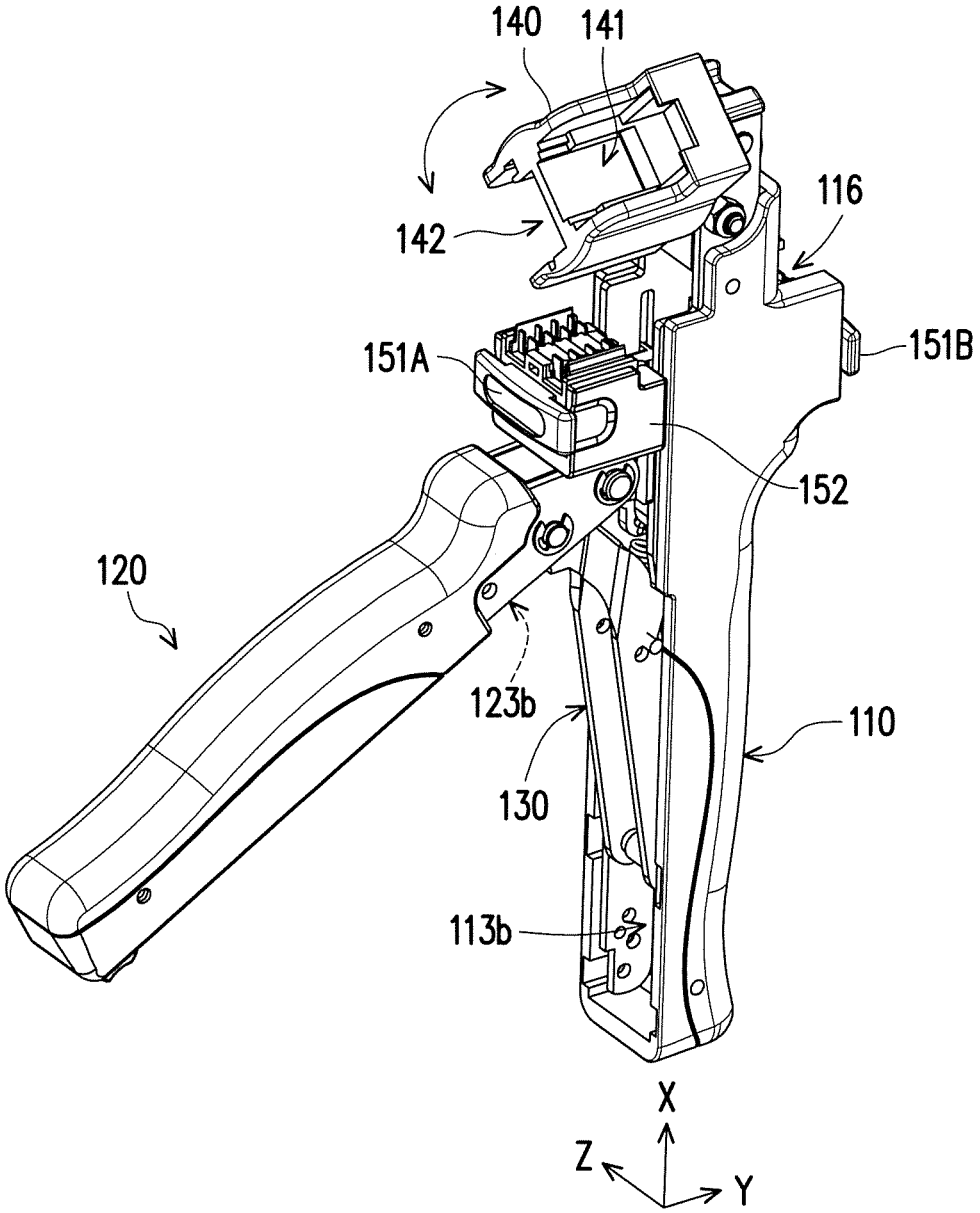
FIG. 7 is a schematic view illustrating the switching of the crimping hand tool of FIG. 1.

FIG. 7 is a schematic view illustrating the switching of the crimping hand tool of FIG. 1. As described above, the first base 140 has the different supporting areas 141 and 142, thereby capable of performing cable crimping operation on different types of jacks. At the same time, as shown in FIG. 1 and FIG. 2, the first body 110 further has a third base 116 that faces away from the second base 152. The third base 116 is adapted to accommodate another crimping head 151B that serves as a standby. Hence the user may, as shown in FIG. 7, switch the supporting areas in accordance with different types of jacks, and interchange the crimping head 151A, which is originally placed on the second base 152, with another crimping head 151B that is on standby. Consequently, the application range of the crimping hand tool 100 is expanded.

With reference to FIG. 2, FIG. 4 and FIG. 5 again, in this embodiment, the crimping hand tool 100 further includes an elastic member 160 that is connected between the second base 152 and the linking member 130 and constantly drives the second base 152 to move in the direction of the negative X-axis. More specifically, as shown in FIG. 2, one end of the elastic member 160 is connected to a pivoting member 161 disposed on the second base 152, and the other end of the elastic member 160 is connected to a pivoting member 162 disposed on the linking member 130 (located between the fourth portion 131 and the fifth portion 132). As shown in FIG. 5, when the user applies a force to the first body 110 and/or the second body 120 to perform crimping so as to move the crimping assembly 150 in the direction of the positive X-axis, the elastic member 160 is in a deformed state. Consequently, after the user removes the applied force, due to a resilient force of the elastic member 160, the first body 110, the second body 120, the linking member 130 and the crimping assembly 150 are reset to the state as shown in FIG. 4.

In addition, the crimping hand tool 100 further includes a stopping block 171 pivoted to the second body 120 and located between the sixth portion 121 and the seventh portion 122. Correspondingly, one end of the linking member 130 has a ratchet structure. More specifically, as the linking member 130 is constituted by the fourth portion 131 and the fifth portion 132 that are coupled, one end of the fourth portion 131 and one end of the fifth portion 132 have a ratchet structure 131*a* and a ratchet structure 132*a* respectively. When the linking member 130 is moved as shown in FIG. 4 and FIG. 5, a protrusion 171*b* of the stopping block 171 is located on a moving path of the ratchet structure 131*a* or 132*a* to temporarily interfere with the ratchet structure 131*a* or 132*a*. As a result, when the first body 110 and the second body 120 are pivoted with respect to each other, the stopping block 171 may temporarily interfere with the ratchet structure 131*a* or 132*a* so as to be engaged with the linking member 130. Here the embodiment does not intend to limit the position of the stopping block 171 on the second body 120. In other words, any position that enables the stopping block 171 to temporarily interfere with the ratchet structure 131*a* or 132*a* may be taken into consideration for the present embodiment.

On the other hand, the crimping hand tool 100 further includes an elastic member 172 connected between the stopping block 171 and a pivoting member 173, and the pivoting member 173 is connected between the sixth portion 121 and the seventh portion 122. When the stopping block 171 does not interfere with the ratchet structure 131*a* or 132*a*, the protrusion 171*b* of the stopping block 171 substantially coincides with a structure extension direction of the second body 120. The interference between the ratchet structure 131*a* or 132*a* and the stopping block 171 causes the stopping block 171 to pivot and consequently deforms the elastic member 172. It is not until the interference is released that the elastic member 172 drives the stopping block 171 to reset. In this embodiment, the stopping block 171 further has a force application portion 171*a* that extends to and protrudes out of an exterior part of the linking member 130. The force application portion 171*a* is adapted to be forced to drive the stopping block 171 so as to make the stopping block 171 either interfere with or move away from the ratchet structure 131*a* or 132*a*. For example, when the first body 110 and the second body 120 are engaged with each other in the case of abnormal crimping during the crimping process, the user may apply a force to the force application portion 171*a* to rotate the stopping block 171, so that the stopping block 171 and the ratchet structure 131*a* or 132*a* are detached from each other to release the engagement. Here the temporary interference means that the user either additionally applies a force to release the engagement relation or reapplies a force to make the components engaged with each other.

Moreover, the crimping hand tool 100 further includes a knob 174 that is disposed on the second body 120 but penetrates through the second portion 121 to connect the force application portion 171*a*. The knob 174 is provided to assist the user to apply a force of rotation so as to achieve the foregoing effect of detaching the stopping block 171 from the ratchet structure 131*a* or 132*a*. In other embodiments (not shown), the user may directly drive the stopping block 171 with a suitable tool (such as a screwdriver) without using the knob.

Figure 8:
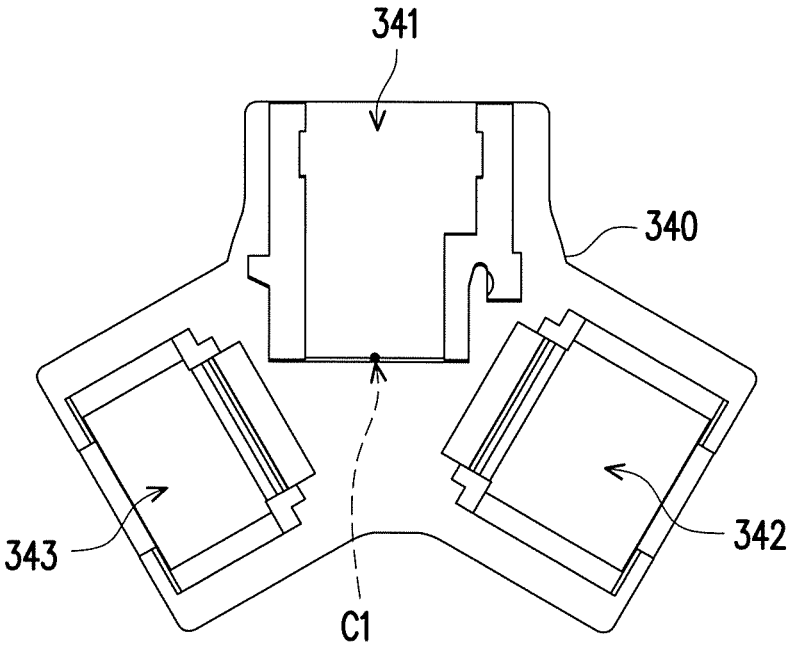
FIG. 8 shows a schematic view of a base of a crimping hand tool according to another embodiment of the invention.

FIG. 8 shows a schematic view of a base of a crimping hand tool according to another embodiment of the invention. This embodiment is similar to the embodiment illustrated in FIG. 7, in which the first base 140 is pivoted to the first body 110 along the Y-axis so that the effect of switching the different supporting areas 141 and 142 is achievable by rotating the first base 140. In this embodiment as shown in FIG. 8, a base 340, just as the foregoing first base 140, likewise supports different types of jacks with different supporting areas 341, 342 and 343. In this embodiment, the base 340 is similarly connected to the first body by a pivoting center C1 so that the user may likewise achieve the goal of switching the different supporting areas 341, 342 and 343 by rotating the base 340. Here the embodiment does not intend to limit the number and type of the supporting area, and the designer may set up the corresponding base according to the crimped object.

In summary, according to the foregoing embodiments of the invention, the first body and the second body of the crimping hand tool are respectively pivoted to the linking member to achieve a pivoting effect, and the crimping assembly is slidably assembled to the first body while pivoted to the second body. Consequently, when at least one of the first body and the second body receives an external force so as to be pivoted with respect to each other, the pivoting movement of the second body drives the crimping assembly to slide on the first body, thereby achieving the required crimping operation. Accordingly, the user first temporarily disposes the plurality of wires of the cable on the jack and then places the cable and the jack in the supporting area so as to crimp all the wires into the jack simultaneously by the foregoing crimping operation to complete the crimping process of the cable.

Furthermore, the first base has supporting areas that correspond to different types of jacks so that the user may switch the supporting areas as desired and required. The first body is additionally provided with a base at the back for accommodating a standby crimping head. Consequently, it is possible to improve the application range and operational convenience of the crimping hand tool.

Although the embodiments are already disclosed as above, these embodiments should not be construed as limitations on the scope of the invention. It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A crimping hand tool adapted to crimp a plurality of wires of a cable into a jack, the crimping hand tool comprising:

a first body;

a second body;

a linking member having two opposite ends, wherein the two opposite ends are pivoted to the first body and the second body respectively;

a crimping assembly slidably assembled to the first body and pivoted to the second body, wherein the crimping assembly comprises:

a second base slidably assembled to a guiding portion of the first body, the second body being pivoted to the second base; and a crimping head detachably assembled to the second base, and a first base movably assembled to the first body and located on a moving path of the crimping assembly, wherein the first base has a plurality of supporting areas; each of the plurality of supporting areas switchably faces toward the crimping assembly by following the first base that moves with respect to the first body; one of the plurality of supporting areas is adapted to allow the jack to be placed therein to face toward the crimping assembly; and at least one of the first body and the second body is forced to slide the crimping assembly toward the one of the plurality of supporting areas through the second body and the linking member.

2. The crimping hand tool as recited in claim 1, wherein the crimping assembly is slidably assembled to the first body along a first axis, the first base is pivoted to the first body along a second axis, and the first axis is orthogonal to the second axis.

3. The crimping hand tool as recited in claim 2, wherein a structure extension direction of the first body coincides with the first axis.

4. The crimping hand tool as recited in claim 1, wherein the first body further has a connecting base portion located in a first accommodating groove of the first body, and the first base is pivoted to the connecting base portion.

5. The crimping hand tool as recited in claim 1, further comprising:

an elastic member connected between the second base and the linking member.

6. The crimping hand tool as recited in claim 1, wherein the first body further has a third base facing away from the second base and adapted to accommodate another crimping head.

7. The crimping hand tool as recited in claim 1, wherein the crimping head comprises:

a main body;

a plurality of crimping protruding members disposed inside the main body in an array, wherein when the crimping assembly moves toward the one of the plurality of supporting areas, the plurality of crimping protruding members correspondingly crimp the plurality of wires into the jack; and at least one cutting blade assembled to the main body and located on at least one side of the plurality of crimping protruding members, wherein orthogonal projections of the plurality of crimping protruding members onto the at least one cutting blade are located within a range of the at least one cutting blade and are spaced apart.

8. The crimping hand tool as recited in claim 7, wherein the at least one cutting blade comprises a pair of cutting blades located on two opposite sides of the plurality of crimping protruding members.

9. The crimping hand tool as recited in claim 1, wherein the first body has a first accommodating groove that forms at least a portion of the guiding portion, and the second base slidably contacts the first accommodating groove.

10. The crimping hand tool as recited in claim 9, wherein the first accommodating groove further has at least one reaming groove located on at least one inner wall of the first accommodating groove, the second base has at least one sliding block slidably assembled to the at least one reaming groove, and the at least one reaming groove forms another portion of the guiding portion.

11. The crimping hand tool as recited in claim 1, wherein one end of the linking member has a ratchet structure, and the crimping hand tool further comprises:

a stopping block pivoted to the second body to temporarily interfere with the ratchet structure.

12. The crimping hand tool as recited in claim 11, wherein the stopping block has a force application portion that extends to and protrudes out of an exterior part of the linking member, and the force application portion is adapted to be forced to drive the stopping block so as to make the stopping block either interfere with or move away from the ratchet structure.

13. The crimping hand tool as recited in claim 12, further comprising:

a knob disposed on the second body to connect the force application portion.

14. The crimping hand tool as recited in claim 1, wherein the first body comprises:

a first portion and a second portion that are coupled and assembled together, the linking member being pivoted between the first portion and the second portion.

15. The crimping hand tool as recited in claim 14, wherein the first body further comprises a third portion that has a concave structure; the first portion and the second portion are assembled in the concave structure and face each other; the concave structure, the first portion and the second portion form a first accommodating groove of the first body; and the linking member is movably located in the first accommodating groove.

16. The crimping hand tool as recited in claim 1, wherein the linking member comprises a fourth portion and a fifth portion that are coupled, and one end of the fourth portion and one end of the fifth portion are pivoted to the first body respectively.

17. The crimping hand tool as recited in claim 16, wherein at least one of another end of the fourth portion and another end of the fifth portion has a ratchet structure.

18. The crimping hand tool as recited in claim 1, wherein the second body comprises a sixth portion and a seventh portion that are coupled and assembled together, and the linking member is pivoted between the sixth portion and the seventh portion.

19. The crimping hand tool as recited in claim 18, wherein the second body further comprises:

an eighth portion that has another concave structure, wherein the sixth portion and the seventh portion are assembled in the another concave structure and face each other; the another concave structure, the sixth portion and the seventh portion form a second accommodating groove of the second body; and the linking member is movably located in the second accommodating groove.

* * * * *